US008857660B2

(12) United States Patent
Omdoll et al.

(10) Patent No.: US 8,857,660 B2
(45) Date of Patent: Oct. 14, 2014

(54) SOLID FOOD PRODUCT CONTAINER DISPENSER

(75) Inventors: Paul Omdoll, Brookfield, WI (US); Michael Young, Mukwonago, WI (US)

(73) Assignee: San Jamar, Inc., Elkhorn, WI (US)

( * ) Notice: Subject to any disclaimer, the term of this patent is extended or adjusted under 35 U.S.C. 154(b) by 1779 days.

(21) Appl. No.: 12/162,456

(22) PCT Filed: Jan. 29, 2007

(86) PCT No.: PCT/US2007/002213

§ 371 (c)(1), (2), (4) Date: Jul. 14, 2011

(87) PCT Pub. No.: WO2007/089609

PCT Pub. Date: Aug. 9, 2007

(65) Prior Publication Data

US 2011/0259949 A1 Oct. 27, 2011

Related U.S. Application Data

(60) Provisional application No. 60/762,707, filed on Jan. 27, 2006.

(51) Int. Cl.

| | |
|---|---|
| ***B65D 21/00*** | (2006.01) |
| ***A47F 1/08*** | (2006.01) |
| ***A47F 7/00*** | (2006.01) |

(52) U.S. Cl.

CPC ..... *A47F 7/0071* (2013.01); *A47F 1/085* (2013.01)

USPC ..... 221/307; 221/308; 221/310; 221/63

(58) Field of Classification Search

USPC ..... 221/307, 308, 310, 63

See application file for complete search history.

(56) References Cited

U.S. PATENT DOCUMENTS

| | | | | |
|---|---|---|---|---|
| 1,661,441 | A * | 3/1928 | Ohlson | 221/63 |
| 2,991,910 | A * | 7/1961 | Coe | 221/305 |
| 4,319,696 | A * | 3/1982 | Stevens | 221/310 |
| 6,325,243 | B1 * | 12/2001 | Bennett | 221/307 |
| 6,966,454 | B2 * | 11/2005 | Kawolics et al. | 221/241 |
| 2003/0146240 | A1 * | 8/2003 | Kawolics et al. | 221/307 |
| 2003/0222098 | A1 * | 12/2003 | Luu et al. | 221/307 |
| 2004/0251157 | A1 * | 12/2004 | Behnke et al. | 206/446 |
| 2009/0057334 | A1 * | 3/2009 | Pearl et al. | 221/307 |

* cited by examiner

*Primary Examiner* — Patrick Mackey

(74) *Attorney, Agent, or Firm* — Boyle Fredrickson, S.C.

(57) ABSTRACT

The present invention provides an improved system and method for dispensing solid food product containers. It comprises a shaped dispensing tube (62) of a predetermined length, having a plurality of support clips (76) arranged inside the dispensing tube (62) for holding a stack of solid food product containers (70) in place within the tube (62). The dispensing tube (62) preferably includes a bracket (68) for mounting the entire device on a wall or the like. A nested stack of containers (70) is fed into the preferably open top (78) of the dispensing tube (62) until the bottommost container engages (or is engaged by) the support clips (76). This results in the bottommost container extending a predetermined distance below the bottom of the dispensing tube (62). By minimizing the amount the bottommost container extends below the dispensing tube (62), a user's ability to take more than one solid food container at a time is greatly minimized.

23 Claims, 16 Drawing Sheets

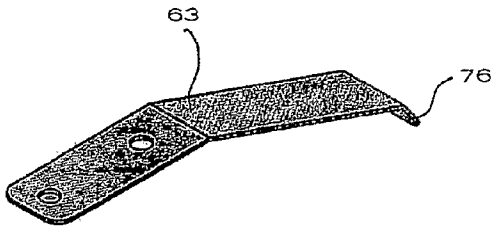
FIG. 17
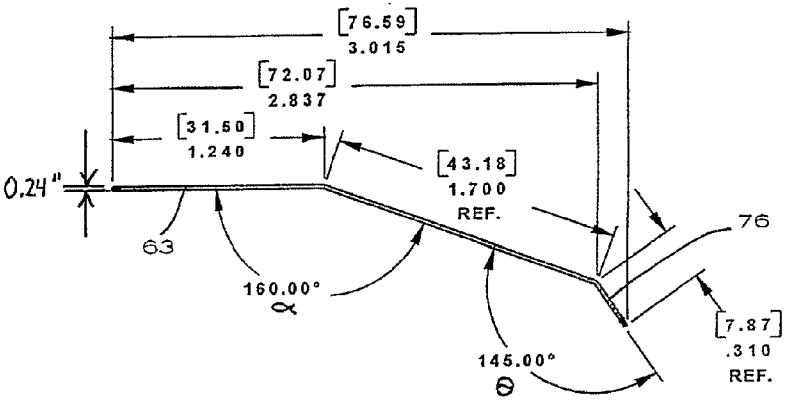
FIG. 19
FIG. 16
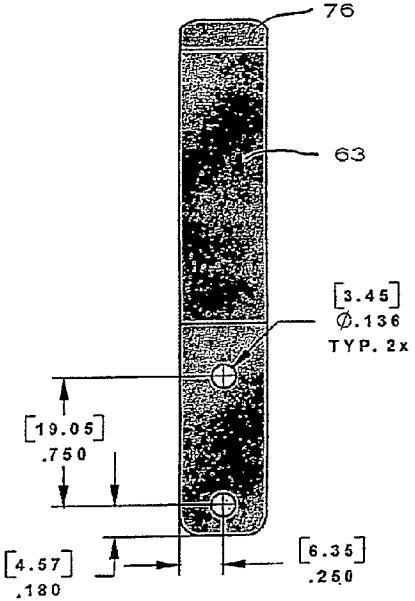
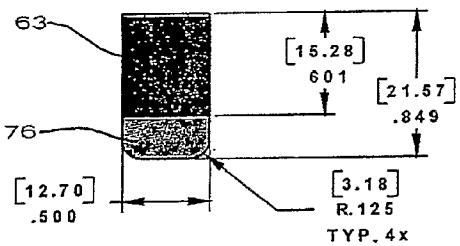
FIG. 18

SOLID FOOD PRODUCT CONTAINER DISPENSER

CROSS-REFERENCE TO RELATED APPLICATION

This application claims the benefit of U.S. Provisional Application Ser. No. 60/762,707, filed Jan. 27, 2006.

FIELD OF THE INVENTION

The present invention relates generally to dispensers for dispensing products and more particularly to a system and method for dispensing containers for solid food products.

BACKGROUND OF THE INVENTION

In a fast food environment, solid food products such as French fries are typically provided to consumers in small paper bags or larger cardboard containers. A store of bags or containers is generally provided in a stack from which one is selected. In one common approach, the selected bag or container is fitted on the bottom of a scoop and French fries funneled into the container or bag with the scoop. In another common approach, where the container is more like a traditional drinking cup, the fries are scooped or poured into the container without fitting the container on the end of the scoop.

Where cardboard containers are used (as opposed to paper bags), the containers have historically had two shapes. The first shape, shown in FIG. 1, is the shape of a traditional drinking cup 10 with a lip 12. The second shape is consistent with the more flattened container 20 shown in FIG. 2. This container 20 is of a generally rectangular configuration with a higher back wall 22 providing for or assisting in the scooping of the fries into the container.

Each of these shapes has drawbacks. The traditional drinking cup shape does not display the French fries in the cup except to the extent they extend above the lip of the cup. Moreover, such a shape is generally relatively expensive to make because of the thickness of cardboard used to make the cup. With the rectangular shape shown in FIG. 2, the container, when filled, will normally lie flat on its back panel such that the contents will tend to spill from the open mouth, unless the container is held upright in the consumer's hand or is otherwise physically maintained in a vertical position, for example, being wedged in a serving tray by adjacent products. Where a scoop is used to fill this container shape, problems may arise because of the relatively narrow elongate nature of the scoop and the angular interior corners of the scoop.

Various alternatives have been suggested to overcome the problems inherent in the shapes shown in FIGS. 1 and 2. More particularly, U.S. Pat. Nos. 6,053,403 and 6,561,414, incorporated herein by reference, disclose improved container designs having substantially circular upper cross sections and generally rectangular lower cross sections. These containers 40 are made without a rim, with a minimum of folds and can be made of lighter weight materials than traditional drinking cup shapes. (See FIGS. 4 and 5). They can not only be readily accommodated within a conventional cup holder, whether in a carrying tray or a vehicle, but also provide a stable base for self-standing.

In the process of providing solid food products to consumers, the ready availability of containers is critical. However, not only must containers be readily available, they must be kept sanitary and out of harm's way. With prior shaped packages for dispensing French fries, two principal types of dispensers have been used to keep containers available. The first type of dispenser is a standard cup dispenser for rimmed standard drink cups that are used for French fries of the type shown in FIG. 1. The second type of dispenser is for holding the rectangularly shaped elongated containers of the type shown in FIG. 2. This type of dispenser, shown in FIG. 3, has a long channel open along its centerline. While this dispenser 30 holds solid food product containers securely, all of the containers are exposed to the air—a configuration that is not ideal from a sanitary standpoint. Moreover, this configuration does not sufficiently inhibit multiple container dispensing.

With the invention of the improved solid food product containers depicted in U.S. Pat. Nos. 6,053,403 and 6,561,414 additional dispensing problems have arisen. These new designs do not work in standard drinking cup dispensers since they lack the rim necessary to fully engage the dispensing mechanism. Still further, the nearly circular cross-section of the top of the new container designs such as that shown in FIG. 4 cannot fit in the same dispenser previously used to dispense the more rectangularly shaped elongated containers. (See FIGS. 2 and 3).

As can be seen, the current approaches to providing solid food product containers to persons who have the task of filling them with solid food products suffer from certain drawbacks and limitations. Accordingly, a need exists for a system and method that provides an improvement over existing dispensing systems and methods, and solves certain problems associated with existing systems and methods.

SUMMARY OF THE INVENTION

The present invention provides an improved system and method for dispensing solid food product containers. It comprises a shaped dispensing tube of a predetermined length, having a plurality of support clips arranged inside the dispensing tube for holding a stack of solid food product containers in place within the tube. The dispensing tube preferably includes a bracket for mounting the entire device on a wall or the like. A nested stack of containers is fed into the preferably open top of the dispensing tube until the bottommost container engages (or is engaged by) the support clips. This results in the bottommost container extending a predetermined distance below the bottom of the dispensing tube. By minimizing the amount the bottommost container extends below the dispensing tube, a user's ability to take more than one solid food container at a time is greatly minimized.

The dispenser of the present invention provides a number of significant advantages over prior solid food container dispensers. First, since the dispensing tube completely surrounds a nested stack of solid food product containers to be dispensed, it maintains the containers in a more sanitary state. Second, the shape of the dispensing tube itself forces a stack of nested solid food product containers to be placed in the dispenser in the proper orientation. Third, the configuration of the clips and the amount to which the bottommost solid food container extends beneath the bottom of the dispensing tube minimizes a user's ability to deliberately or accidentally take multiple solid food product containers with a single pull. These and other objects and advantages of the present invention will become apparent from the detailed description, claims, and accompanying drawings.

DESCRIPTION OF THE DRAWINGS

FIG. 16 is a front view of one embodiment of a clip of the present invention showing certain preferred dimensions FIG. 17 is a perspective view of the clip of FIG. 16;

FIG. 18 is bottom view of the clip of FIG. 16 showing certain preferred dimensions;

FIG. 19 is a side view of the clip of FIG. 16 showing certain preferred dimensions and angles;

DETAILED DESCRIPTION OF THE PREFERRED EMBODIMENTS

As shown in FIGS. 6-15, the dispenser 60 of the present invention includes a central tube 62 and a plurality of support clips 63, 64, 65 and 66. The dispenser 60 preferably also includes a bracket 68 for mounting the dispenser to a wall or the like (not shown).

Figure 1:
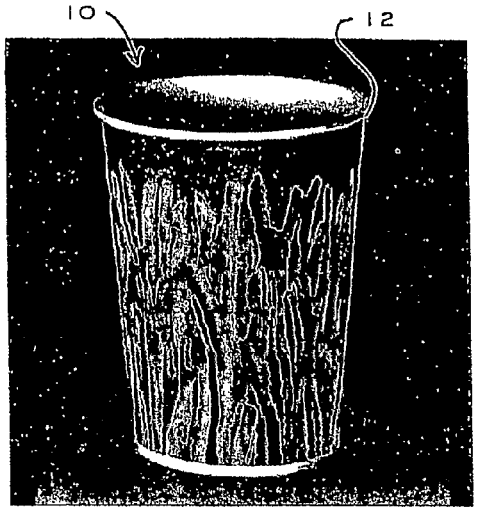
FIG. 1 is a perspective view of a solid food container in the form of a traditional drinking cup.
Figure 2:
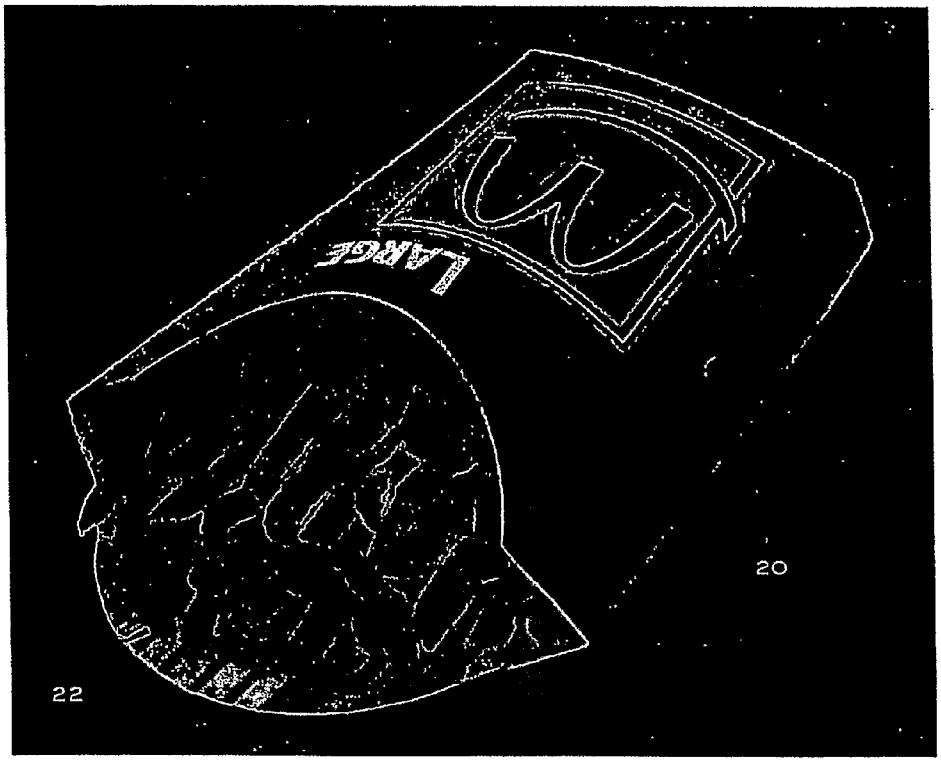
FIG. 2 is a perspective view of a second type of solid food container with a generally rectangular shape.
Figure 3:
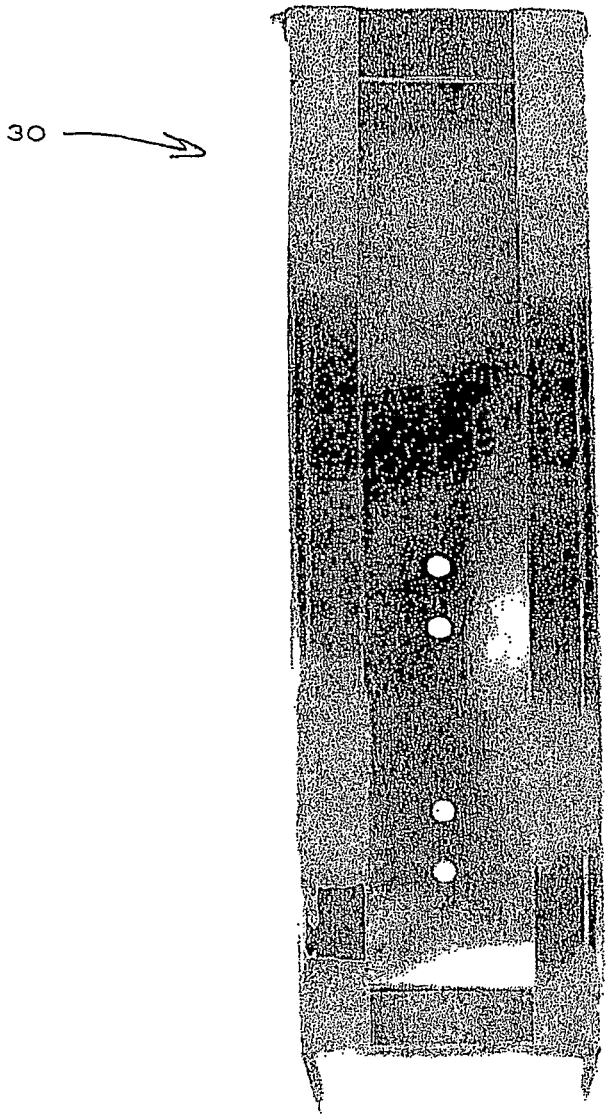
FIG. 3 is a front view of a prior art solid food container dispenser.
Figure 4:
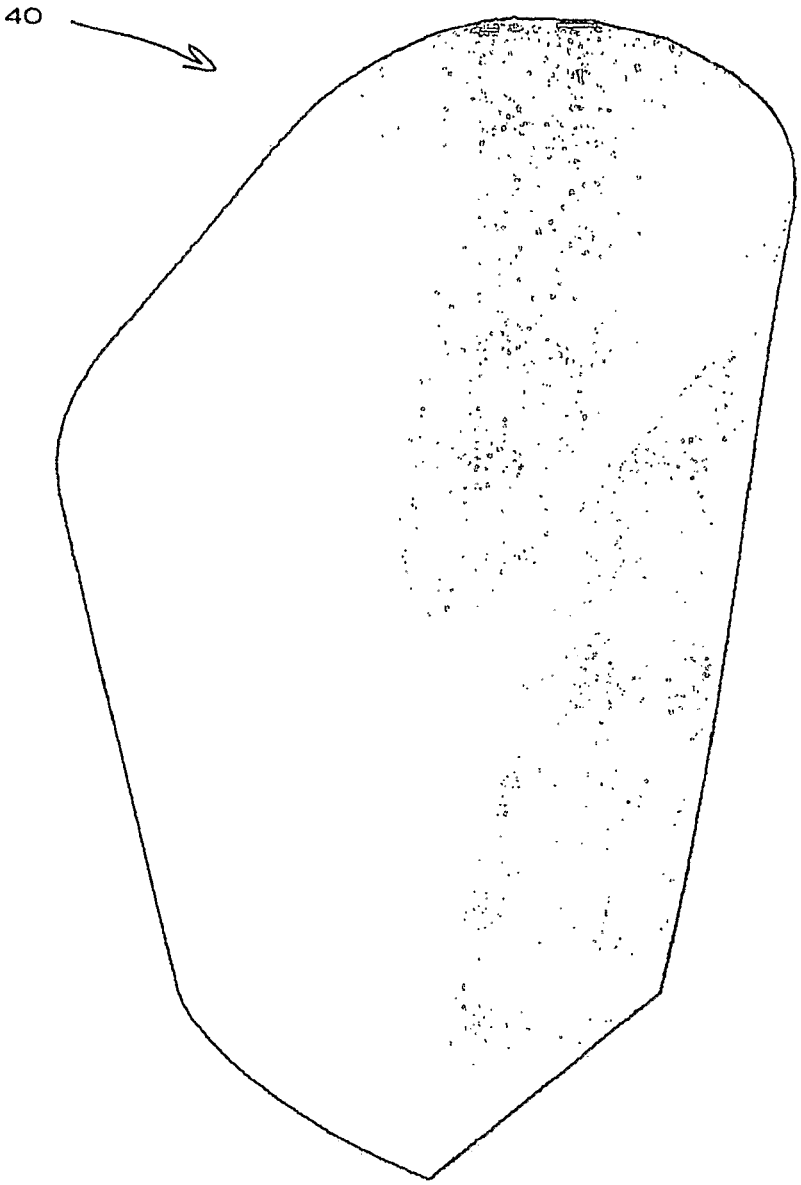
FIG. 4 is a top perspective view of a one type of solid food container used in conjunction with the present invention.
Figure 5:
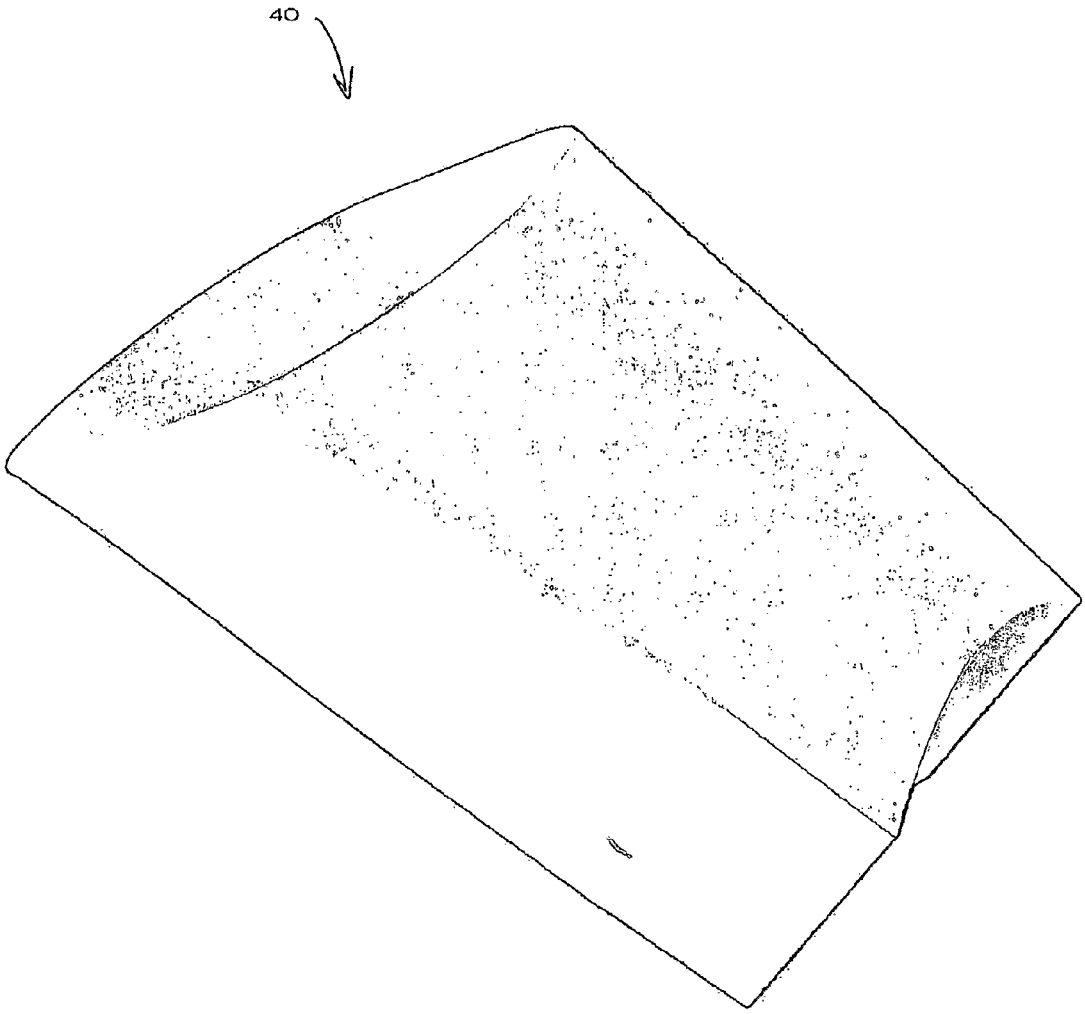
FIG. 5 is a side perspective view of the solid food container of FIG. 4.
Figure 6:
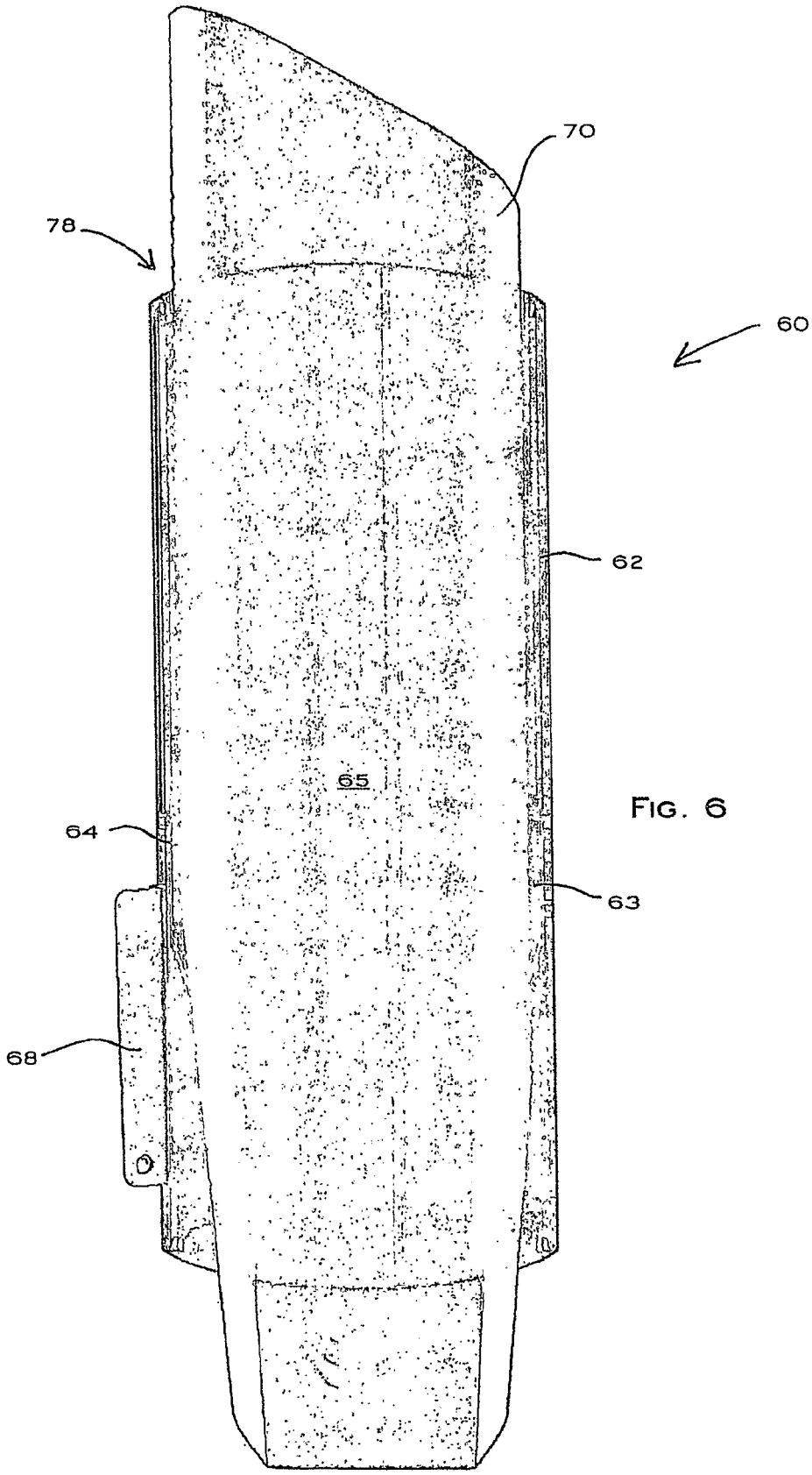
FIG. 6 is a side view of one embodiment of the present invention filled with a nested stack of solid food product containers with the dispensing tube shown in phantom.
Figure 7:
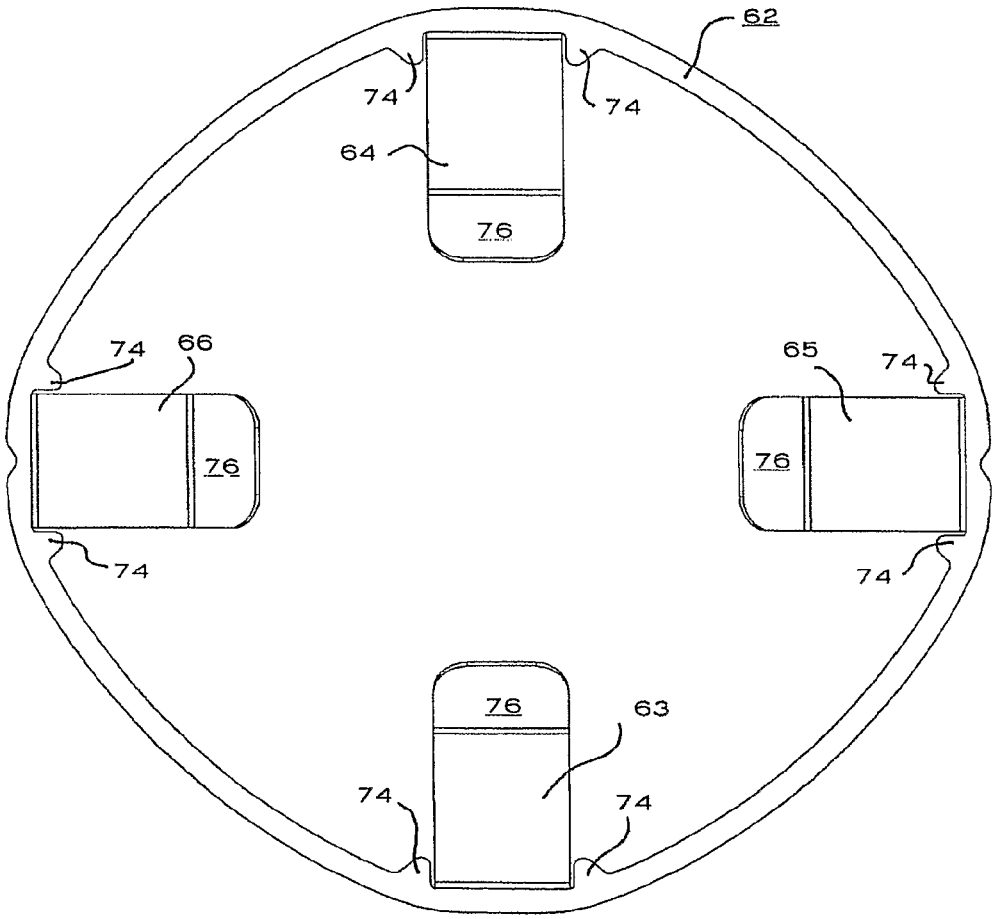
FIG. 7 is bottom view of one embodiment of the dispenser of the present invention.
Figure 8:
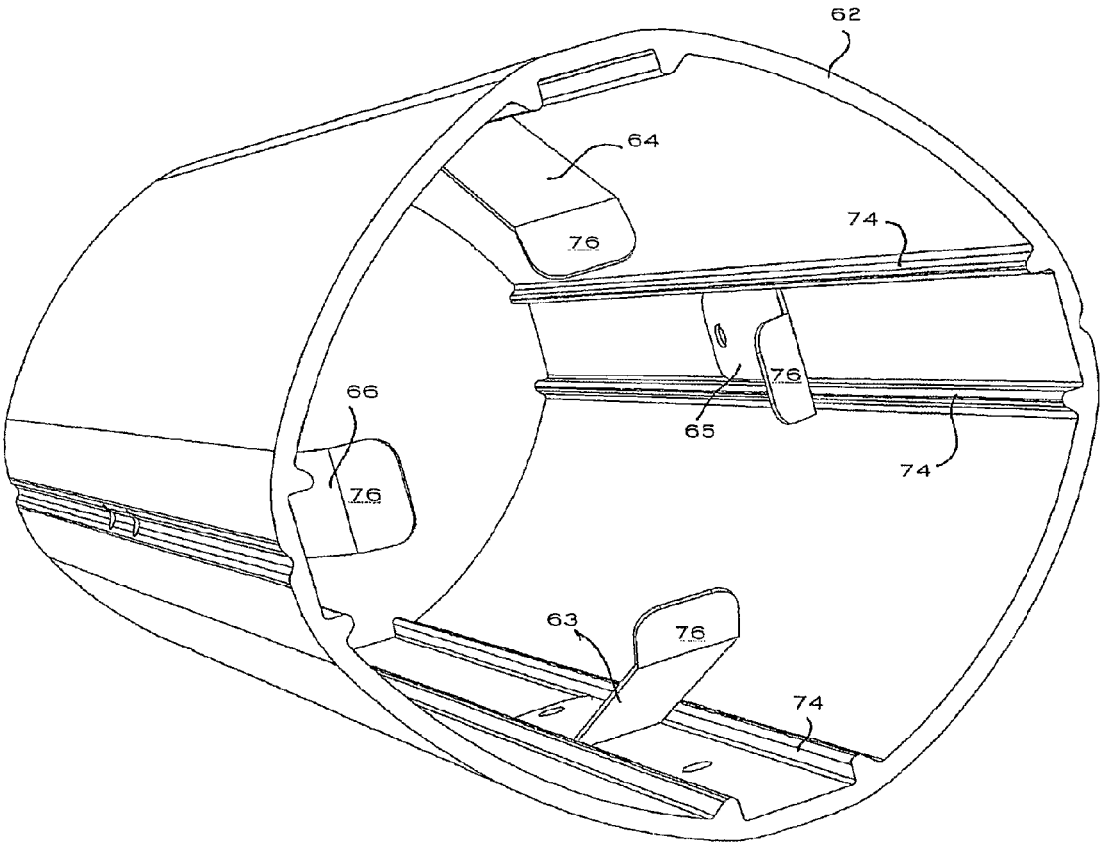
FIG. 8 is a bottom perspective view of one embodiment of the present invention.
Figure 9:
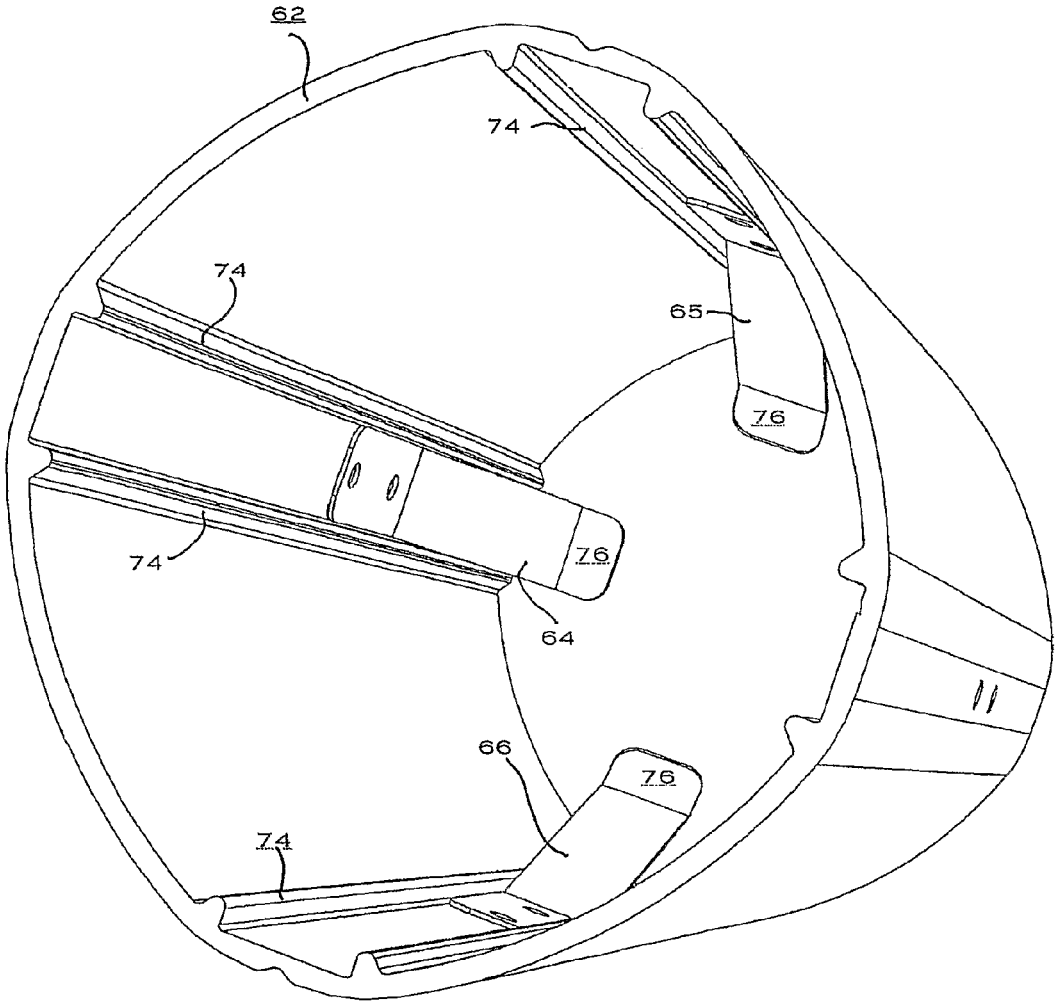
FIG. 9 is a top perspective view of one embodiment of the present invention.
Figure 10:
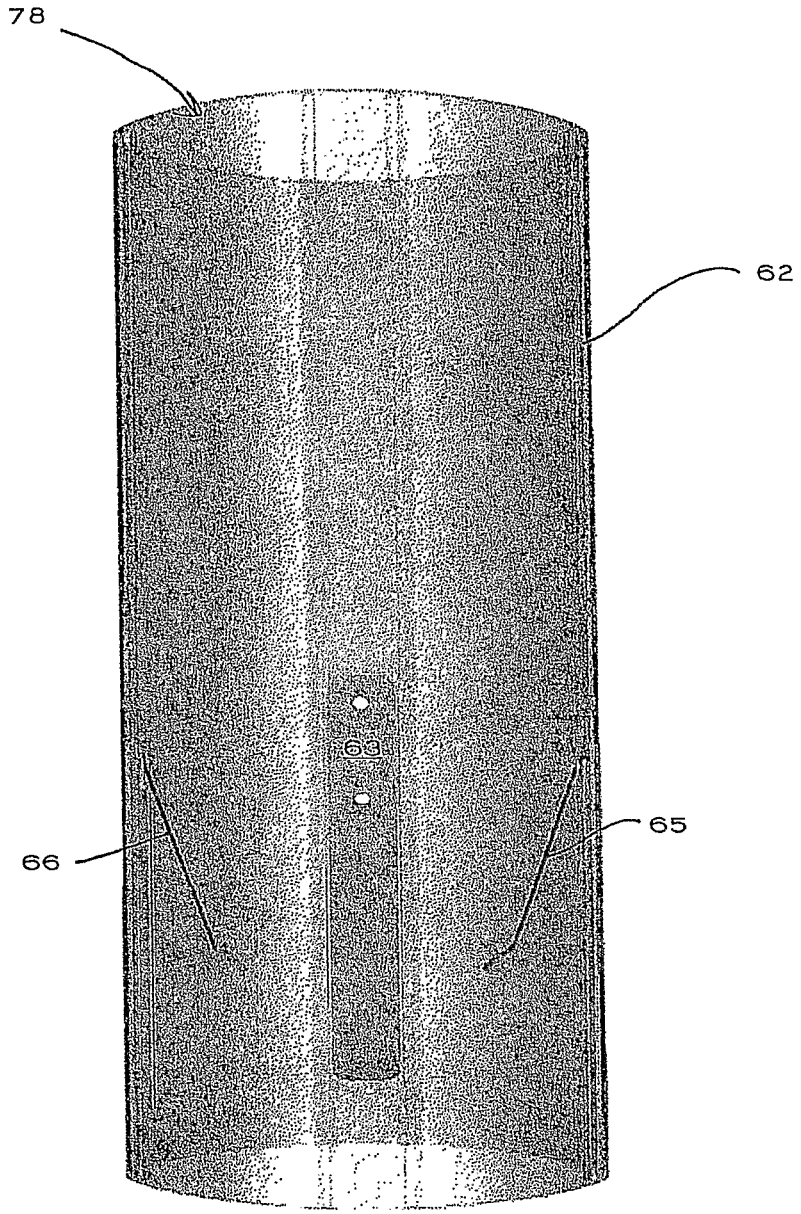
FIG. 10 is a front view of one embodiment of the present invention showing the support clips with the dispensing tube shown in phantom.
Figure 11:
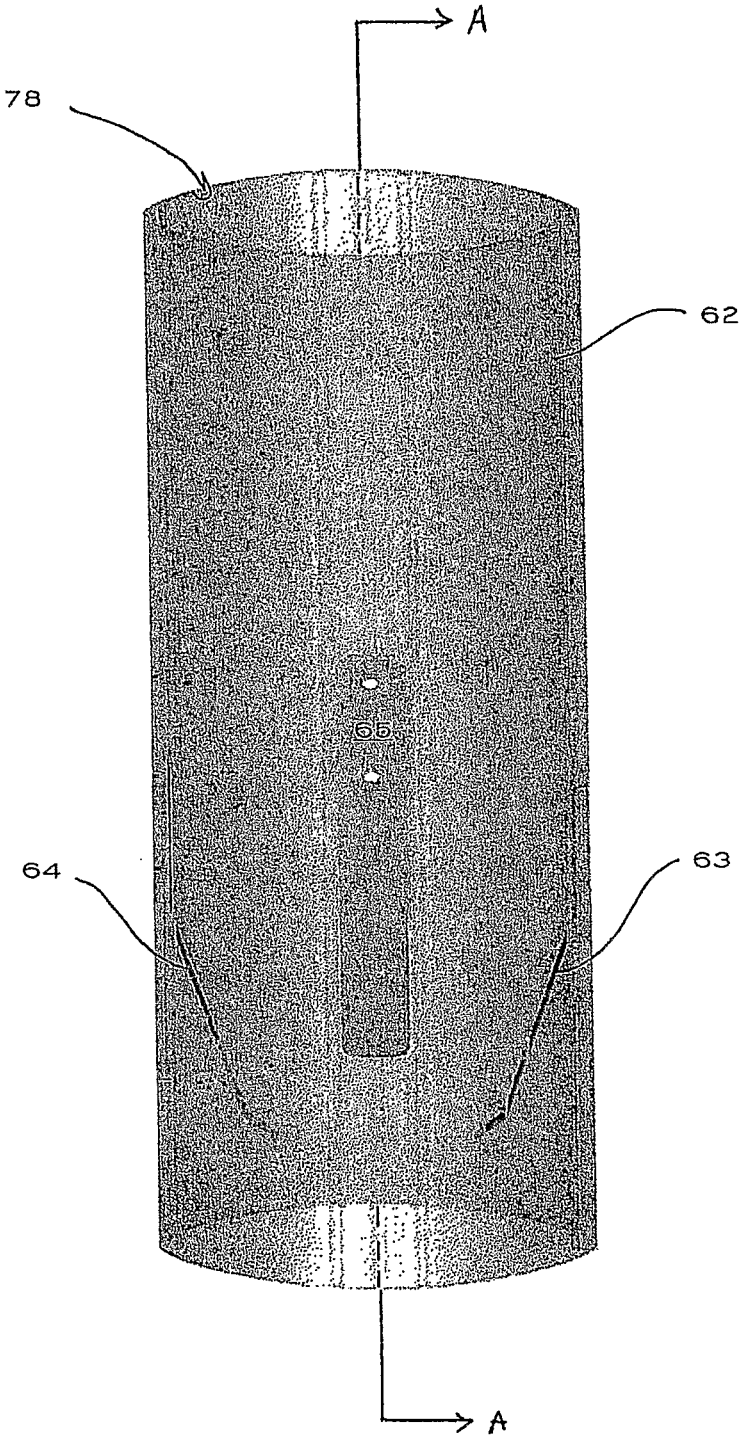
FIG. 11 is a side view of one embodiment of the present invention showing the support clips with the dispensing tube shown in phantom.
Figure 12:
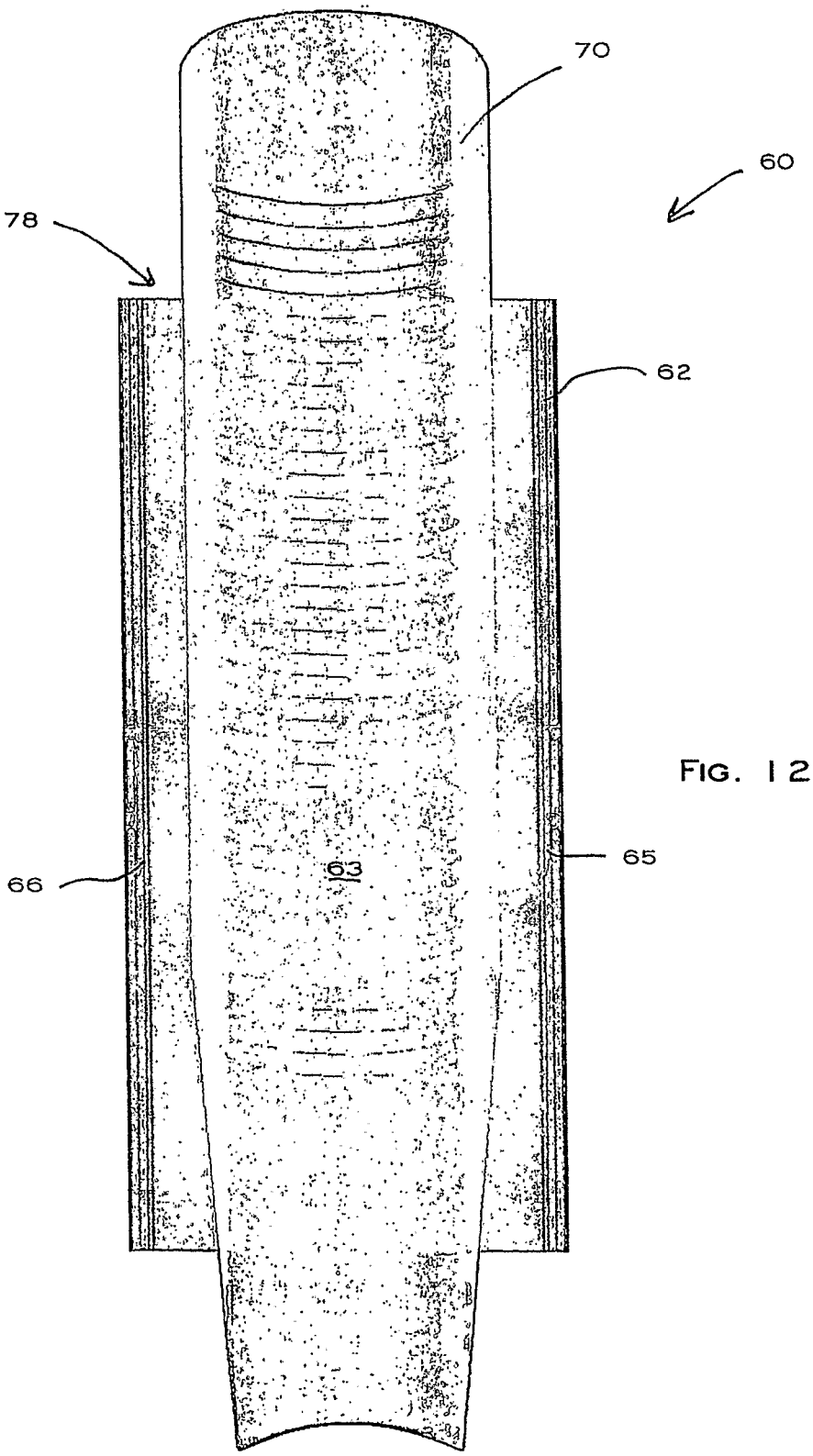
FIG. 12 is a front view of one embodiment of the present invention filled with a nested stack of solid food product containers with the dispensing tube shown in phantom.
Figure 13:
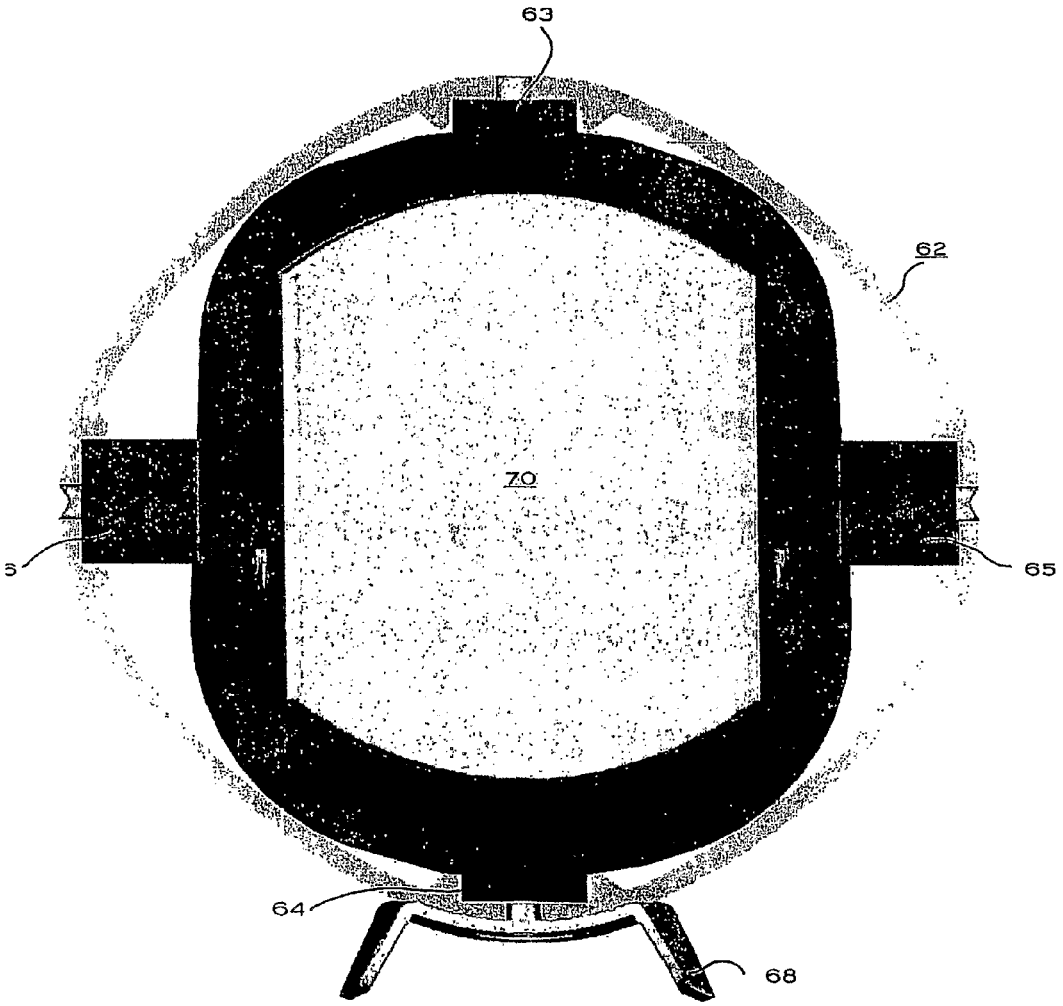
FIG. 13 is a bottom view of one embodiment of the present invention filled with a nested stack of solid food product containers.
Figure 14:
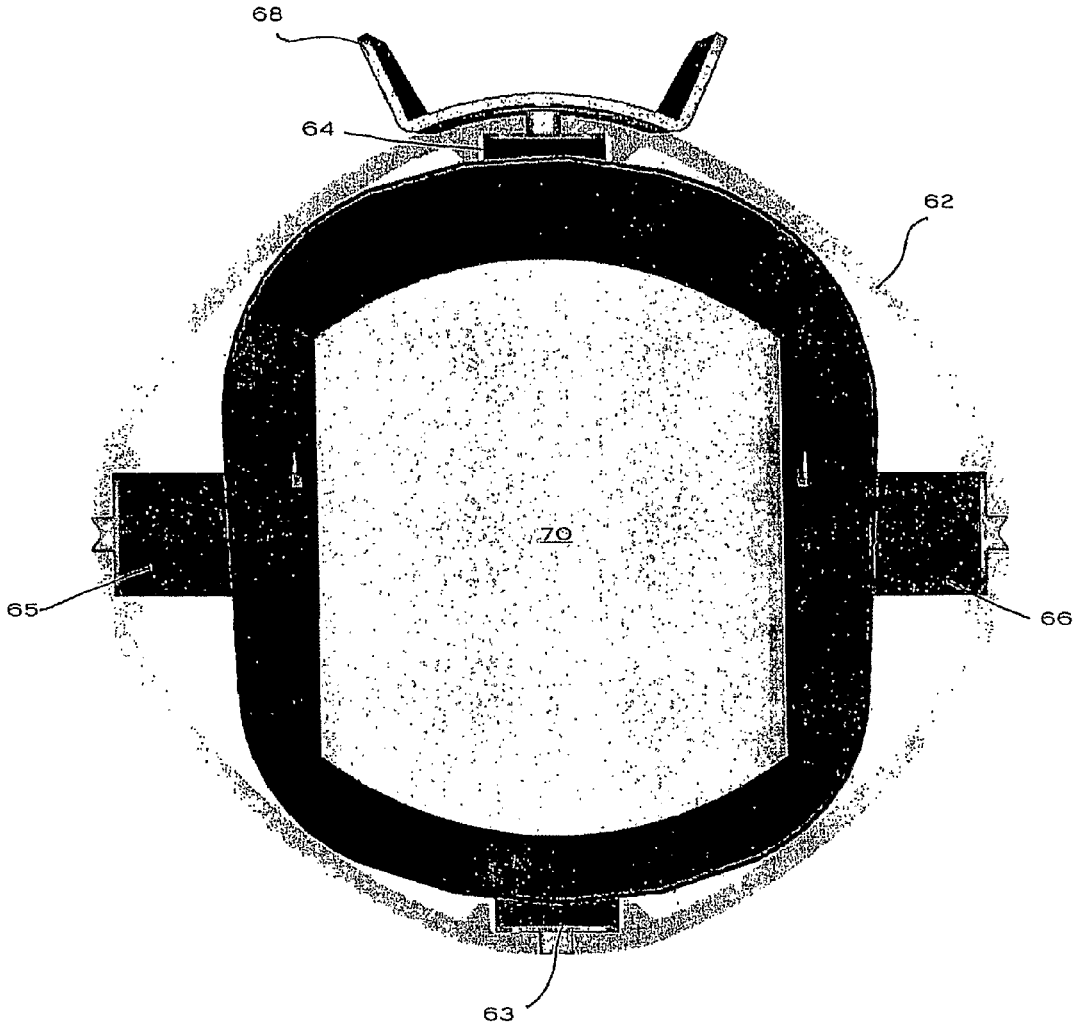
FIG. 14 is a top view of one embodiment of the present invention filled with a nested stack of solid food product containers.
Figure 15:
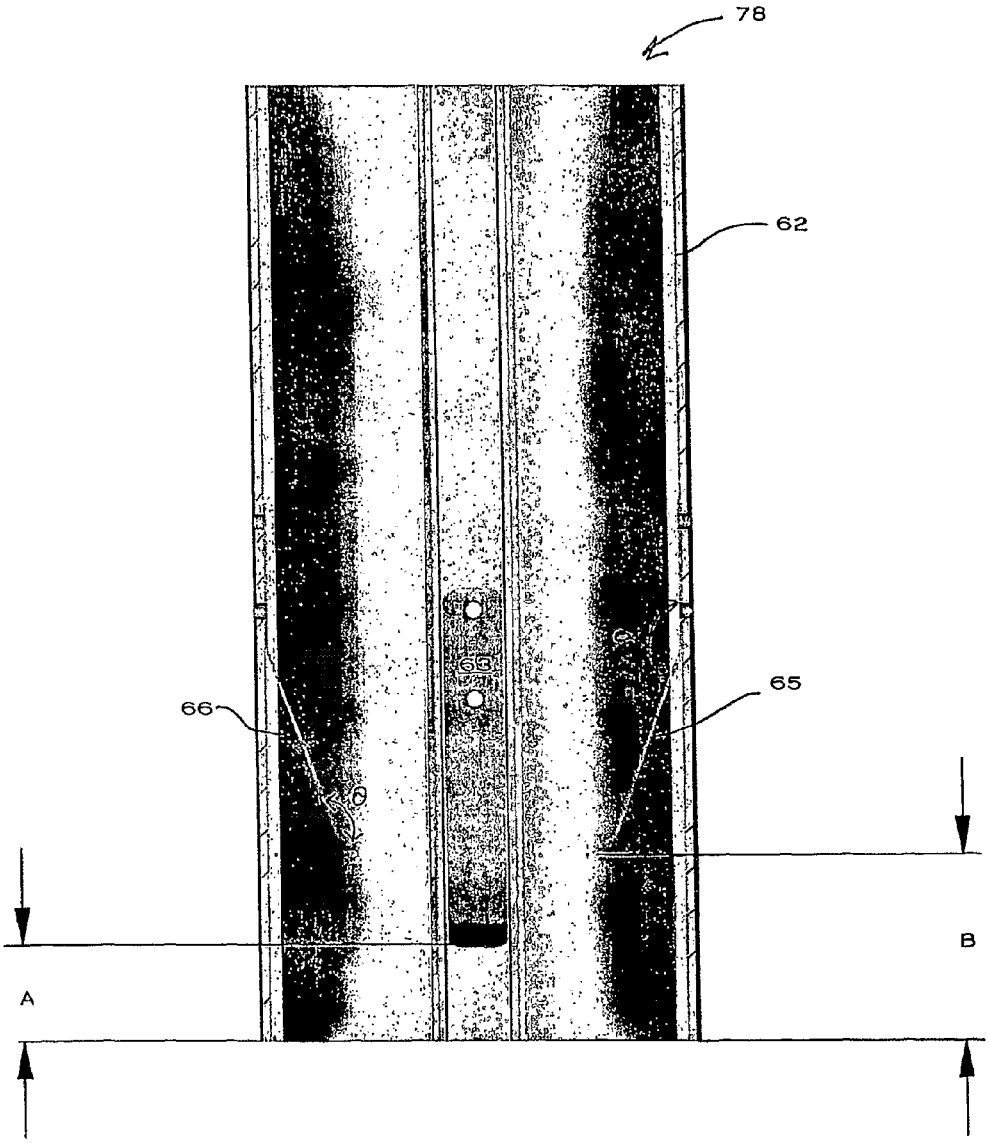
FIG. 15 is a cross-sectional view of one embodiment of the present invention taken along line A-A of FIG. 11.

The dispensing tube 62, as shown in FIGS. 7-9, is an irregular oval shape. Four clips 63, 64, 65 and 66 are placed substantially evenly around the tube 62. The clips are placed in channels 72 that are defined by longitudinal areas of increased thickness 74. While not necessary to the operation of the present invention, these areas of increased thickness provide increased stability, resistance to breakage and further define the interaction between a nested stack of solid food product containers 70 and the dispensing tube 62. The tube 62 is preferably made from polycarbonate to withstand the heat of the traditional French fry and other solid food preparation environments, but may be made of metal or any other rigid material with heat resistance appropriate to the particular environment.

As shown in FIGS. 6-15, the clips 63, 64, 65 and 66 are mounted in opposing pairs inside the lower portion of the dispensing tube 62. Clips 63 and 64, located in the front and back of the inner portions of the tube 62, are set lower in the tube 62 while clips 65 and 66, located on the sides of the inner portions of the tube 62, are set higher. This juxtaposition is helpful for achieving optimal dispensing. The higher, side mounted clips 65 and 66 do most of the work as far as dispensing and cup separation. The front and back clips 63 and 64 are positioned lower than the side clips 65 and 66 mainly because the fronts of most solid food product containers are angled down from back to front. This lower position enables the front clip 63 to engage the lower-most solid food container while the rear clip 64 acts to position the stack 70 that simply pushes the cup stack forward and helps to hold the stack 70 in position within the tube.

Referring to FIGS. 10-12 and 15, preferably, the lower end of the front and back clips 63 and 64 is located about 0.8 inches above the bottom of the tube 62 (Distance A) when the solid food container to be dispensed has a height of approximately 4.75 inches. In other words, the height of the bottom of the clips 63 and 64 is set at approximately 50% of the height of a 4.75 inches container when the container is properly seated in the dispenser 60 for dispensing. Distance A is about 2.3 inches when the solid food container to be dispensed has a height of approximately 6.0 inches, or approximately 65% of the height of a 6.0 inch container when the container is properly seated in the dispenser 60 for dispensing. Distance A is about 2.8 inches when the solid food container to be dispensed has a height of approximately 6.25 inches, or approximately 70% of the height of a 6.25 inch container when the container is properly seated in the dispenser 60 for dispensing. All of these heights are adjustable depending upon various factors including the exact configuration and dimensions of the container, the width of the tube 62 and the degree of angle and rigidity of the clips 63 and 64.

Preferably, the lower end of the side clips 65 and 66 is located about 1.5 inches above the bottom of the tube 62 (Distance B) when the solid food container to be dispensed has a height of approximately 4.75 inches. In other words, the height of the bottom of the clips 65 and 66 is set at approximately 65% of the height of a 4.75 inch container when the container is properly seated in the dispenser 60 for dispensing. Distance B is about 3.0 inches when the solid food container to be dispensed has a height of approximately 6.0 inches, or approximately 75% of the height of a 6.0 inch container when the container is properly seated in the dispenser 60 for dispensing, Distance B is about 3.5 inches when the solid food container to be dispensed has a height of approximately 6.25 inches, or approximately 80% of the height of a 6.25 inch container when the container is properly seated in the dispenser 60 for dispensing. All of these heights are adjustable depending upon various factors including the exact configuration and dimensions of the container, the width of the tube 62 and the degree of angle and rigidity of the clips 65 and 66.

As shown in FIGS. 7-11 and 15-19, all the clips 63, 64, 65, and 66 have an angled extension 76 that permits the clips to "dig in" to the containers to facilitate the separation of the individual containers from the stack 70. The tension imparted by the clips 63, 64, 65 and 66 and the manner and location that it is imparted is what ultimately facilitates the maintenance of the containers within the dispenser 60 and the one-by-one withdrawal of the containers without damage. The thickness and material of the clips, as well as their angle and location of contact with the containers principally determines the tension imparted on the containers. In one embodiment of the present invention the clips initially have an angle α which, as shown in FIG. 19, is preferably about 160° as measured from the side of the tube 62. In one embodiment, the ends of the clips have a second angle θ as measured from the first part of the clip which is preferably about 145°. As with most other clip dimensions described herein, these angles may be adjusted depending upon various factors including the exact configuration and dimensions of the container, the width of the tube 62 and the degree of rigidity of the clips 63, 64, 65 and 66.

The exact shape and size of the tube 62 also plays a role in determining the tension applied to the stack 70. For example, the front and back mounted clips 63 and 64, because of the shape of the tube 62, are much closer, as measured from their point of attachment to the tube 62, to the nested stack 70 of containers as compared to the side mounted clips 65 and 66. However, since the shape of the containers tapers inwardly from top to bottom, the location of the clips (the front and back ones 63 and 64 being mounted lower than the two side ones 65 and 66) also affects the imparted tension.

Preferably, the clips 63, 64, 65 and 66 are made from metal, most preferably stainless steel having a thickness of about 0.24 inches. The thickness can be adjusted depending on various factors including the exact tensile strength of the stainless steel employed, the size of the containers in the stack and the width and exact shape of the tube 62. The clips 63, 64, 65 and 66 could also be made from plastic or other rigid material capable of imparting sufficient tension on the stack of nested containers 70 and creating an appropriate point of contact. In one embodiment of the present invention, the distance between containers in a stack of nested containers is only about 0.1 inches and only one container at a time is preferably contacted by a given clip. As such, the width of the clip can be a factor in ensuring the proper operation of the present invention.

In use, a nested stack of containers 70 is fit into the tube 62 through the top 78. Because of the shape of the tube 62, the stack 70 can only be placed in the tube 62 in proper orientation. The stack 70 is pushed into the tube 62 until it engages all the clips 63, 64, 64 and 66. At that point, the bottommost container in the stack 70 will preferably protrude between about 1-2 inches below the bottom of the tube 62, and most preferably, about 1.5 inches below the bottom of the tube 62. This is preferably something less than about 30% of the height of a single container stored in the tube 62. This limited extension of the container outside the tube prevents a user from grasping the bottommost cup and pinching it in a way that would result in the dispensing of multiple cups at a given time.

The tube 62 is preferably about 8 inches in length but need not be so limited. Keeping the tube 62 shorter has the advantage of minimizing the likelihood of any jams and providing for relatively easy correction if one should occur. A longer tube, on the other hand, can support a greater supply of containers requiring less monitoring and refilling.

Figure 20:
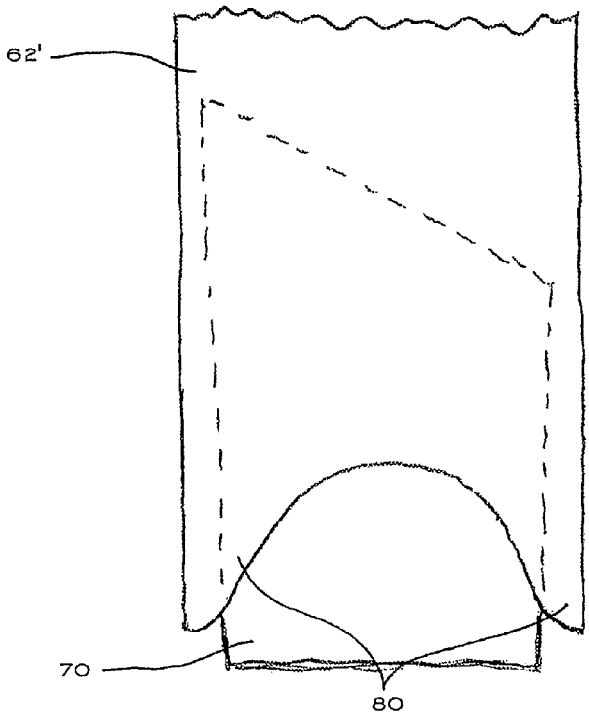
FIG. 20 is a side view of a second embodiment of the tube of the present invention.
Figure 21:
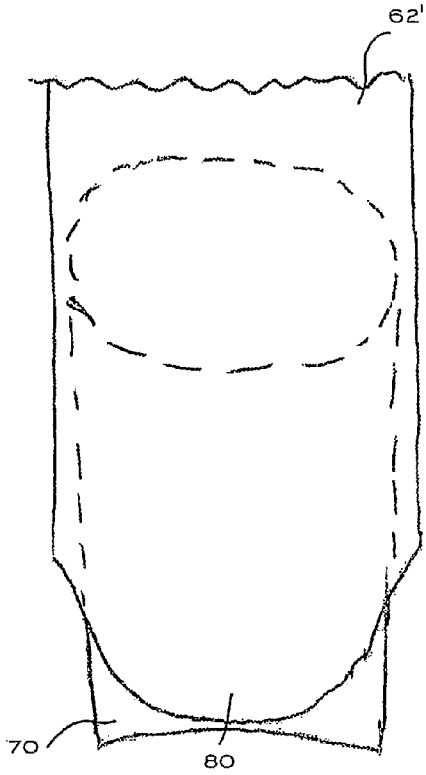
FIG. 21 is a front view of the embodiment of FIG. 20.

FIGS. 20 and 21 show a second embodiment of the tube of the present invention. In this embodiment, the tube 62' has extended areas 80 that substantially cover the front and back of the bottommost cup in the stack 70. This configuration limits still further, the ability of a user to pinch the stack of nested containers 70 and remove more than one container since access is limited to grasping the bottommost container from the sides.

The dispenser of the present invention may be implemented in a variety of configurations, using certain features or aspects of the several embodiments described herein and others known in the art. Thus, although the invention has been herein shown and described in what is perceived to be the most practical and preferred embodiments, it is to be understood that the invention is not intended to be limited to the specific features and embodiments set forth above. Rather, it is recognized that modifications may be made by one of skill in the art of the invention without departing from the spirit or intent of the invention and, therefore, the invention is to be taken as including all reasonable equivalents to the subject matter disclosed herein.

The invention claimed is:

1. A solid food product container dispenser comprising:

a shaped tube of a predetermined length for maintaining a plurality of stacked food product holders therein; and a plurality of clips mounted towards the distal end of said shaped tube, the clips having a first portion slidably adjustable on an interior surface of the shaped tube and a second portion forming an acute angle with respect to the interior surface of the shaped tube, wherein the second portion extends toward a discharge end of the shaped tube, wherein said clips engage the lowermost of stacked food product holders maintained in said shaped tube to facilitate one-by-one dispensing of the food product holders.

2. A solid food product container dispenser according to claim 1, wherein the shape of the shaped tube is an irregular oval.

3. A solid food product container dispenser according to claim 1, wherein the shaped tube is made from polycarbonate.

4. A solid food product container dispenser according to claim 1, wherein there are four clips mounted in said shaped tube.

5. A solid food product container dispenser according to claim 4, wherein two of the four clips are mounted at the same relative height position in said shaped tube and wherein said height position is above the height position of the other two clips.

6. A solid food product container dispenser according to claim 5, wherein the height of the bottom of the lower two clips engages the lowermost of a stack of solid food product containers at between about 50-80% of the height of a solid food product container as measured from the bottom of the lowermost container when a stack of containers is properly seated in the dispenser for dispensing.

7. A solid food product container dispenser according to claim 6, wherein the height of the bottom of the lower two clips engages the lowermost of a stack of solid food product containers at about 50% of the height of a solid food product container as measured from the bottom of the lowermost container when a stack of containers is properly seated in the dispenser for dispensing.

8. A solid food product container dispenser according to claim 6, wherein the height of the bottom of the lower two clips engages the lowermost of a stack of solid food product containers at about 65% of the height of a solid food product container as measured from the bottom of the lowermost container when a stack of containers is properly seated in the dispenser for dispensing.

9. A solid food product container dispenser according to claim 6, wherein the height of the bottom of the lower two clips engages the lowermost of a stack of solid food product containers at about 80% of the height of a solid food product container as measured from the bottom of the lowermost container when a stack of containers is properly seated in the dispenser for dispensing.

10. A solid food product container dispenser according to claim 4, wherein the clips are mounted at an angle of about 160° relative to the side of the shaped tube.

11. A solid food product container dispenser according to claim 1, wherein the second portion of the clip has two sections, the second sections of which is at an angle of about 145° relative to the first section.

12. A solid food product container dispenser according to claim 1, wherein the shaped tube has an open top.

13. A solid food product container dispenser according to claim 12, wherein the open top is sized to facilitate the loading of a stack of solid food product containers therein.

14. A solid food product container dispenser according to claim 12, wherein the shaped container is shaped to limit the loading of a stack of solid food product containers to a proper dispensing orientation.

15. A solid food product container dispenser according to claim 1, wherein a stack of solid food product containers properly mounted in said shaped tube, protrudes below the bottom of the shaped tube something less than about 30% of the height of a single container mounted in the tube.

16. A solid food product container dispenser according to claim 1, wherein the plurality of clips are independently adjustable in a vertical direction within the shaped tube.

17. A dispenser comprising:

an irregular oval shaped dispensing tube of a predetermined length, having a plurality of support clips arranged inside said dispensing tube for holding a stack of solid food product containers in place within the tube, wherein the support clips are independently positionable relative to an interior surface of the tube and the lower end of at least one of the clips is vertically offset within the tube relative to the lower end of another of said clips and wherein the bottommost container engages the support clips resulting in the bottommost container extending a predetermined distance below the bottom of the dispensing tube for minimizing the ability of a user to extract more than a single container at one time.

18. A dispenser according to claim 17, wherein the dispenser is adapted to dispense rimless solid food product containers.

19. A dispenser for dispensing rimless solid food containers comprising:

an irregular oval shaped housing of a predetermined length, having at least four clips mounted therein for holding a plurality of solid food containers in said housing, wherein the clips are angled inwardly relative to a circumference of the housing and downwardly toward a discharge end and wherein the lowermost ends of at least two of said clips are offset at a predetermined height above the at least two other of said clips, wherein each said clip is angled relative to said housing to engage at least the lowermost solid food containers held in said housing to facilitate one-by-one dispensing of said solid food containers, and wherein each said clip is independently positionable relative to an interior surface of the tube.

20. A solid food product container dispenser according to claim 17, wherein at least two of the clips are mounted at an angle of about 160° relative to the side of the shaped tube.

21. A solid food product container dispenser according to claim 18, wherein at least two of the clips have two sections, the second sections of which are at an angle of about 145° relative to the first section of the clip.

22. A solid food product container dispenser comprising:

a shaped tube of a predetermined length for maintaining a plurality of stacked food product holders therein;

a plurality of clips mounted towards the distal end of said shaped tube, wherein said clips are angled relative to the shaped tube for engaging the lowermost of stacked food product holders maintained in said shaped tube and facilitating one-by-one dispensing of the food product holders wherein the clips have two sections, the second sections of which are at an angle of about 145° relative to the first section of the clip.

23. A dispenser comprising:

an irregular oval shaped dispensing tube of a predetermined length, having a plurality of support clips arranged inside said dispensing tube for holding a stack of solid food product containers in place within the tube, wherein the bottommost container engages the support clips resulting in the bottommost container extending a predetermined distance below the bottom of the dispensing tube for minimizing the ability of a user to extract more than a single container at one time wherein the dispenser is adapted to dispense rimless solid food product containers; and wherein at least two of the clips have two sections, the second sections of which are at an angle of about 145° relative to the first section of the clip.

* * * * *

UNITED STATES PATENT AND TRADEMARK OFFICE

CERTIFICATE OF CORRECTION

PATENT NO. : 8,857,660 B2
APPLICATION NO. : 12/162456
DATED : October 14, 2014
INVENTOR(S) : Paul Omdoll et al.

It is certified that error appears in the above-identified patent and that said Letters Patent is hereby corrected as shown below:

IN THE CLAIMS

Claim 11, column 7, line 3, delete “sections” and substitute therefore -- section --.

Signed and Sealed this
Sixth Day of January, 2015

Michelle K. Lee

Michelle K. Lee
*Deputy Director of the United States Patent and Trademark Office*